United States Patent [19]

Hou et al.

[11] Patent Number: 4,997,479

[45] Date of Patent: Mar. 5, 1991

[54] HIGH SOLIDS CONTENT CALCIUM STEARATE DISPERSIONS

[75] Inventors: Mean-Jeng Hou, Export; Sai H. Hui, Wexford, both of Pa.

[73] Assignee: PPG Industries, Inc., Pittsburgh, Pa.

[21] Appl. No.: 475,058

[22] Filed: Feb. 5, 1990

[51] Int. Cl.[5] ..... C08L 91/00

[52] U.S. Cl. ..... 106/162; 106/243; 428/537.5; 252/49.3; 252/40.5

[58] Field of Search ..... 252/39, 40.5, 49.3; 106/162, 243; 428/537.5

[56] References Cited

U.S. PATENT DOCUMENTS

| | | | |
|---|---|---|---|
| 3,532,647 | 10/1970 | Ritson et al. | 260/6 |
| 3,642,671 | 2/1972 | Lesinski | 260/9 |
| 3,957,662 | 5/1976 | Sangekar | 252/39 |
| 4,329,177 | 5/1982 | George | 106/38.35 |
| 4,425,452 | 1/1984 | Nakata | 106/214 |
| 4,659,489 | 4/1987 | Hill | 252/40.5 |
| 4,676,836 | 6/1987 | Hill | 106/243 |

OTHER PUBLICATIONS

Starch and Starch Products on Paper Coatings, TAPPI Monograph Series, No. 17, (1947), pp. 108–113, 116.

Encyclopedia of Chemical Technology, Kirk-Othmer, 3rd Edition, John Wiley & Sons, (1981), vol. 16, pp. 789–791.

Encyclopedia of Chemical Technology, Kirk-Othmer, Interscience Publishers, (1952), vol. 9, pp. 842–844.

"Study of Polyethylene Glycols as Lubricants for Paper Coatings", G. B. Kelly, Jr. et al., TAPPI/vol. 53, No. 10, Oct. 1970, pp. 1900–1904.

"Carbowax ® Polyethylene Glycol 4000", Union Carbide Application Bulletin, May, 1968.

*Primary Examiner*—Jacqueline V. Howard

*Attorney, Agent, or Firm*—Edward J. Whitfield

[57] ABSTRACT

This invention relates to urea-free high solids content aqueous calcium stearate dispersions useful as lubricating agents in paper and paperboard coating compositions.

16 Claims, No Drawings

HIGH SOLIDS CONTENT CALCIUM STEARATE DISPERSIONS

BACKGROUND OF THE INVENTION

Aqueous calcium stearate dispersions have long been used as additives in paper coating formulation, the calcium stearate imparting lubricating, leveling and anti-dusting properties to the coating formulation.

Since it is preferable in the paper making industry to use as many predispersed starting materials as possible in preparing various coating formulations, it is advantageous to provide aqueous calcium stearate dispersions having as high a solids content as possible. Such advantages inure in lower shipping costs and introducing less water into the coating formulation.

It is reported that conventional aqueous calcium stearate dispersions containing much above 50 to 55 weight percent solids do not retain desirable rheological properties, i.e., they are quite viscous and difficult to handle and meter. Efforts have therefore been directed to preparing aqueous calcium stearate dispersions having a high solids content, i.e., higher than 55 weight percent.

Some such high solids content calcium stearate compositions having workable viscosities are reported in U.S. Pat. No. 4,659,489 and 4,676,836. U.S. Pat. No. 4,659,489 discloses high solids content, i.e., 50 to 75 weight percent, aqueous dispersions containing calcium stearate, dispersing agent, non-ionic lubricant and urea. U.S. Pat. No. 4,676,836 describes similar compositions, except that anionic lubricant is used in place of the non-ionic lubricant of U.S. Pat. No. 4,659,489. Copending, commonly owned U.S. application Serial No. 07/448,787, filed Dec. 11, 1989 also discloses high solids content, i.e. 60 to 80 weight percent, aqueous calcium stearate dispersions containing calcium stearate, urea and starch syrup.

A possible disadvantage to such urea containing high solids calcium stearate dispersions is that urea, in aqueous solution, slowly hydrolyzes to ammonium carbamate. Moreover, prolonged heating of aqueous urea solution results in formation of biuret and liberation of ammonia. Also, urea containing high solids calcium stearate dispersions tend to colorize, i.e., turn from white to yellow, on prolonged standing. Consequently, it is desirable to provide, as does the present invention, urea-free, high solids content, aqueous calcium stearate dispersion.

THE INVENTION

This invention provides a urea-free, high solids content aqueous calcium stearate dispersion suitable for use as an additive in paper or paperboard coating formulations. More particularly, this invention provides a urea-free aqueous calcium stearate dispersion having a solids content of from about 60 to about 80 weight percent, the balance being water. The solids portion of the dispersion comprises from about 30 to about 55 weight percent of calcium stearate, from about 10 to about 60 weight percent of at least one straight chain polyhydric alcohol and up to about 40 weight percent, e.g., 10 to 30 weight percent, of starch syrup or sugar. A preferred aqueous calcium stearate dispersion of this invention contains from about 60 to 70 weight percent solids, the balance being water; with the solids portion of the dispersion comprising from about 40 to 50 weight percent of calcium stearate, from about 20 to 40 weight percent of straight chain polyhydric alcohol and from about 15 to about 25 weight percent of starch syrup or sugar. Of course, the relative amount of each ingredient comprising the solids portion of the invention dispersion is selected so that the solids total 100 percent.

Calcium stearate is commercially available either in dry powdered form or in the form of aqueous dispersions. In preparing the urea-free, high solids calcium stearate dispersions of the invention, any commercial aqueous calcium stearate dispersion may be used as a starting material. Alternatively, the starting calcium stearate dispersion may be prepared by dispersing powdered calcium stearate in water using conventional dispersing agents. Aqueous calcium stearate dispersion containing from about 40 to about 55 percent solids is a preferred starting material. Aqueous calcium stearate dispersions are typically prepared by reacting stearic acid with aqueous hydrated lime slurry in the presence of conventional, commercially available dispersing agents, such as polyalkoxylated alkyl phenol or dialkyl phenol, e.g., polyethoxylated nonyl phenol or dinonyl phenol. Although it is to be understood that the invention is not intended to be limited by any particular method of making an aqueous calcium stearate dispersion suitable for use as a starting material, nor by any particular dispersing agent used to prepare such dispersion, a particularly preferred aqueous calcium stearate dispersion is that made and sold by PPG Industries, Inc. under the trademark, CALSAN TM 50. The CALSAN TM 50 material contains about 50 weight percent solids, the solids portion of the dispersion comprising about 88 to 90 percent calcium stearate.

Starch syrup is commercially obtainable as a concentrated aqueous solution of partial hydrolyzates of starch and typically contains dextrose, maltose and high oligosaccharides derived from starch by acid or enzyme hydrolysis. Although starch syrup derived from corn starch is preferred for use in accordance with the invention, starch syrup derived from other vegetables, e.g., potatoes, may also be used. Starch syrup suitable for use in accordance with the invention typically has a density in the range of from about 41° to 45° Baume corresponding to a solids content of from about 76 to 84 weight percent.

Sugar, the common name for sucrose, is a disaccharide compound composed of D-glucose and D-fructose having the formula $C_{12}H_{22}O_{11}$. Sugar is a water soluble substance which crystallizes in characteristic monoclinic form and occurs naturally in many plants. Commercially, sugar is obtained by evaporation of clarified sugar cane or sugar beet juice.

The straight-chain polyhydric alcohols suitable for use in accordance with the invention are also staple items of commerce. Exemplary of straight-chain polyhydric alcohols contemplated for use in accordance with this invention include propylene glycol, diethylene glycol, dipropylene glycol, triethylene glycol, or the like. Polyethylene or polypropylene glycols having a molecular weight of from about 200 to about 800, preferably from about 300 to about 600, are also suitable for use. Other polyhydric alcohols that may be used are, e.g., glycerol, sorbitol, mannitol, pentaerythritol or the like. It is, of course, to be understood that mixtures of straight-chain polyhydric alcohols may also be used. Straight-chain polyhydric alcohols containing from 2 to 6 carbon atoms in the chain are preferred for use in the invention. Of these, diethylene glycol and/or glycerol are particularly preferred.

In a preferred embodiment of this invention, high solids content aqueous calcium stearate dispersion is prepared by admixing at least one straight-chain polyhydric alcohol and starch syrup or sugar in the desired amounts with preformed aqueous calcium stearate dispersion containing from about 40 to about 55 weight percent solids. In accordance with this invention, a particularly preferred high solids content aqueous calcium stearate dispersion may be prepared by blending about 65 parts by weight of aqueous calcium stearate dispersion, containing about 50 weight percent solids (e.g., the aforementioned CALSAN TM 50 dispersion), with about 17.5 parts by weight polyhydric alcohol (e.g., diethylene glycol) and about 17.5 parts by weight of starch syrup or sugar (e.g., corn syrup). The resulting dispersion will have a solids content of about 65 weight percent, the balance being water. The aqueous dispersions of the present invention have, in addition to high solids content, workable viscosities which typically range from about 100 up to about 500 cps Brookfield at 60 rpm and are very compatible with conventional starch, protein or latex-type (e.g., styrene-butadiene, acrylic or polyvinyl acetate) paper coating formulations.

The dispersions of the invention lubricate the coating in the wet state, providing improved flow and leveling characteristics and also permit increased steam usage during supercalendaring operations to achieve desired gloss levels by holding dusting to a minimum. Paper and paperboard sized with coatings incorporating the invention dispersions exhibit a smoother, more satinlike feel and texture, particularly after supercalendaring and are less likely to exhibit cracking after creasing or folding.

The invention is further illustrated but is not intended to be limited by the following Examples, wherein all parts and percentages are by weight, unless otherwise specified.

EXAMPLE 1

An aqueous calcium stearate dispersion of the invention was prepared by admixing 17.5 parts of diethylene glycol, 17.5 parts of corn syrup (about 80 percent solids) and 65 parts of Calsan TM 50 aqueous calcium stearate dispersion containing about 50 percent solids. The resulting stable dispersion had a solids content of about 65 percent and a Brookfield viscosity of about 150 cps at 60 rpm. The dispersion showed no tendency to separate or discolor even on standing for several weeks; nor were there any perceptible odor problems.

EXAMPLE 2

A paper coating formulation was prepared by admixing 85 parts of #1 coating clay, 5 parts of titanium dioxide, 10 parts of Hydrocarb TM 65 clay pigment, 3 parts of Penford TM 280 starch, 13 parts of Polysar TM 1164 latex binder, 0.24 part of CureSan TM 199 binder insolubilizer, 0.73 part of the aqueous calcium stearate dispersion prepared as described in Example 1 and sufficient water such that the coating formulation had a total solids content of about 64 percent. The pH of the coating formulation was adjusted to about 8.0 with dilute, aqueous ammonium hydroxide solution.

EXAMPLE 3

A paper coating formulation was prepared by admixing 75 parts of #2 coating clay, 5 parts of titanium dioxide, 20 parts of delaminated clay, 8 parts of Penford TM 280 starch, 10 parts of Polysar TM 1164 latex binder, 0.64 part of CureSan TM 199 binder insolubilizer, 0.67 part of the aqueous calcium stearate dispersion prepared as described in Example 1 and sufficient water such that the coating formulation had a total solids content of about 60 percent. The pH of the coating formulation was adjusted to about 8.0 with dilute, aqueous ammonium hydroxide solution.

The paper coating formulations prepared as described in Examples 1 and 2 had rheological properties substantially the same as otherwise identical coating formulations containing equivalent amounts of commercially available 65 percent solids content, urea-containing aqueous calcium stearate dispersion in place of the calcium stearate dispersion of the invention. Also, the urea-free calcium stearate dispersion of the invention is less reactive to the glyoxal contained in the binder insolubilizer than is the said urea-containing calcium stearate dispersion. In addition, paper coated with a coating formulation containing a calcium stearate dispersion of the invention exhibited improved printability than did paper coated with a coating formulation containing said commercially available urea-containing calcium stearate dispersion.

Although the invention has been described in some detail in the foregoing, it is to be understood that many variations may be made therein without departing from the spirit and scope thereof as defined by the appended claims.

We claim:

1. An aqueous calcium stearate dispersion having a solids content of from about 60 to about 80 weight percent, the balance being water, the solids content of the dispersion consisting essentially of from about 30 to about 55 weight percent of calcium stearate, from about 10 to about 60 weight percent of at least one straight-chain polyhydric alcohol other than sugar and up to about 40 weight percent of starch syrup or sugar or mixtures thereof.

2. The dispersion of claim 1 having a solids content of from about 60 to about 70 weight percent, the balance being water, the solids content comprising from about 40 to about 50 weight percent of calcium stearate, from about 20 to about 40 weight percent of at least one straight-chain polyhydric alcohol and from about 10 to about 30 weight percent of starch syrup or sugar or mixtures thereof.

3. The dispersion of claim 1 wherein the polyhydric alcohol is selected from propylene glycol, diethylene glycol, dipropylene glycol, triethylene glycol, polyethylene or polypropylene glycols having a molecular weight of from about 200 to about 800, glycerol, sorbitol, mannitol, pentaerythritol, or mixtures thereof.

4. The dispersion of claim 3 wherein the polyhydric alcohol contains from 2 to 6 carbon atoms in the chain.

5. The dispersion of claim 4 wherein the polyhydric alcohol is selected from diethylene glycol, glycerol or mixtures thereof.

6. The dispersion of claim 5 wherein the polyhydric alcohol is diethylene glycol.

7. The dispersion of claim 1 wherein the starch syrup is corn syrup.

8. An aqueous calcium stearate dispersion having a solids content of from about 60 to about 80 weight percent, the balance being water, the solids content consisting essentially of from about 30 to about 55 weight percent of calcium stearate, from about 10 to about 60 weight percent of glycerol, diethylene glycol or mixtures thereof and up to about 40 weight percent starch syrup or sugar or mixtures thereof.

9. The dispersion of claim 8 wherein the solids content consists essentially of from about 40 to about 50 weight percent calcium stearate, from about 20 to about 40 weight percent diethylene glycol and from about 10 to about 30 weight percent starch syrup.

10. Paper or paperboard coating formulation containing the dispersion of claim 1.

11. Paper or paperboard coated with the formulation of claim 10.

12. The dispersion of claim 2 wherein the amount of starch syrup, sugar or mixtures thereof is from about 15 to about 25 weight percent.

13. The dispersion of claim 2 wherein the polyhydric alcohol other than sugar is selected from propylene glycol, diethylene glycol, dipropylene glycol, triethylene glycol, polyethylene or polypropylene glycols having a molecular weight of from about 200 to about 800, glycerol, sorbitol, mannitol, pentaerythritol, or mixtures thereof.

14. The dispersion of claim 13 wherein the polyhydric alcohol other than sugar is selected from diethylene glycol, glycerol or mixtures thereof and the starch syrup is corn syrup.

15. The dispersion of claim 13 wherein the polyethylene or polypropylene glycol has a molecular weight of from about 300 to about 600.

16. The dispersion of claim 3 wherein the polyethylene or polypropylene glycol has a molecular weight of from about 300 to about 600 and the starch syrup is corn syrup.

* * * * *